United States Patent [19]

Grella et al.

[11] Patent Number: 4,785,524

[45] Date of Patent: Nov. 22, 1988

[54] WIRING HEAD

[75] Inventors: Georg Grella, Darmstadt-Wixhausen; Peter Bormuth, Bensheim, both of Fed. Rep. of Germany

[73] Assignee: AMP Incorporated, Harrisburg, Pa.

[21] Appl. No.: 168,370

[22] Filed: Mar. 15, 1988

[30] Foreign Application Priority Data

Apr. 13, 1987 [GB] United Kingdom ..... 8708801

[51] Int. Cl.[4] ..... H01R 43/00

[52] U.S. Cl. ..... 29/564.6; 29/748; 29/753

[58] Field of Search ..... 29/753, 742, 747, 748, 29/564.6, 564.8, 564.1

[56] References Cited

U.S. PATENT DOCUMENTS

| | | | |
|---|---|---|---|
| 4,034,017 | 8/1977 | Folk et al. | 29/749 |
| 4,178,675 | 12/1979 | Phillips | 29/566 |
| 4,238,874 | 12/1980 | Chandler et al. | 29/33 |
| 4,261,087 | 4/1981 | Fleischhacker et al. | 29/33 |
| 4,590,673 | 5/1986 | Dornes et al. | 29/845 |
| 4,667,397 | 5/1987 | Day et al. | 29/748 |
| 4,683,636 | 8/1987 | Henderson et al. | 29/564.6 |

*Primary Examiner*—Carl E. Hall

*Attorney, Agent, or Firm*—Thomas G. Terrell; Bruce J. Wolstoncroft

[57] ABSTRACT

A wiring head (10) mounted for movement along coordinates (X, Y and Z) to insert electrical terminal (T) into selected cavities of electrical connector housings (CH), comprises rolls (38) for feeding a wire (W) in a wire feed direction (D) from a wire reel (20), a wire inserter (24) for inserting the wire (W) so fed, into a terminal (T) at a wire insertion station (54) and a terminal inserter (62, 63) for then inserting the terminal (T) into its cavity. Slides (32 and 34) are moveable towards each other to form a loop (L) in the wire (W), to be inserted into the terminal by the inserter (24), and wire severing blades (58 and 60) are also provided for severing either side of the loop (L), when required according to a wiring program, before a terminal (T) is inserted into its cavity. The inserted terminals (T) are thereby connected in daisy chain fashion, one side of the loop (L) being severed in the case of the end terminals (T) of the chain.

8 Claims, 5 Drawing Sheets

WIRING HEAD

This invention relates to a wiring head in wiring apparatus having means for operatively aligning the wiring head with predetermined cavities in an electrical connector housing to be wired, the wiring head comprising an electrical terminal inserter mounted thereto for reciprocating movement through a terminal insertion stroke and a return stroke, and means for feeding electrical terminals to the inserter, each for insertion thereby into one of said cavities during said insertion stroke.

Such wiring heads are used, for example, in block loading apparatus, where terminals crimped to wires are supplied to the head for insertion into the cavities.

There is, however, now a requirement in respect of the wiring of switching panels, for series of the terminals to be electrically connected together prior to their insertion into their respective cavities so that the wiring head must be capable of producing, what is in effect, a daisy chain harness during the terminal insertion operations. The present invention is intended to provide a wiring head which is capable of doing this.

According to the present invention, a wiring head as defined in the first paragraph of the specification, further comprises a wire inserter mounted to the head for reciprocating movement through a wire insertion stroke and a return stroke, means for feeding wire from a wire source, in a wire feed direction towards the wire inserter, means operative, prior to the working strokes of the terminal inserter and the wire inserter, for forming the wire so fed, into a loop aligned with a wire receiving portion of the terminal for insertion thereinto by the wire inserter during its wire insertion stroke, means for selectively severing either side of the loop at a position back from the terminal in accordance with a wiring program, and wire pulling means for engaging the wire between the terminal and the wire feeding means following the working stroke of the terminal inserter, to draw further wire from the wire source.

Thus, as described below, the wiring head can be operated to provide an electrical harness, having an electrical terminal at each end, and an indefinite number of electrical terminals connected to the harness at spaced intervals intermediate its ends, each terminal being inserted into a respective cavity in accordance with the wiring program, immediately after the terminal has been connected to the wire.

For a better understanding of the invention, reference will now be made by way of example to the accompanying drawings in which.

Figure 1:
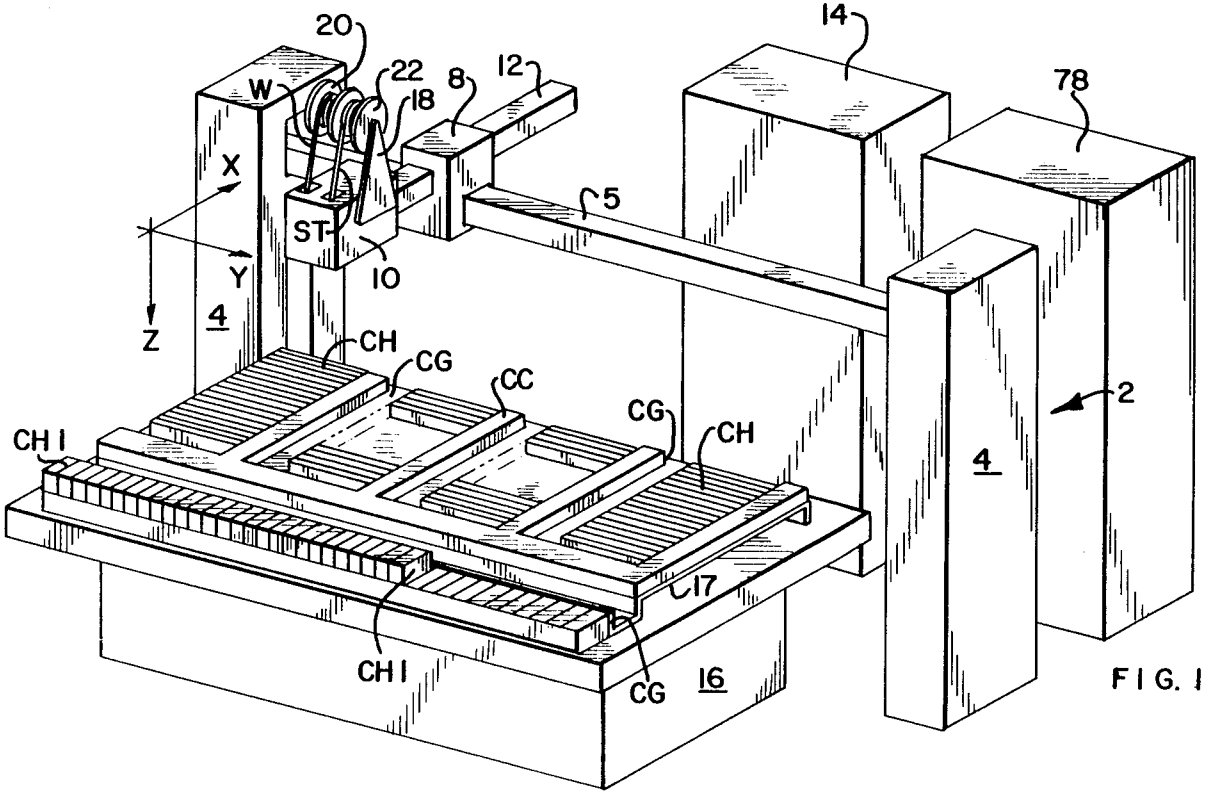
FIG. 1 is a diagrammatic isometric view of an automatic wiring apparatus in situ.

As shown in FIG. 1, the automatic wiring apparatus comprises a free-standing gantry 2, consisting of spaced legs 4, spanned by a horizontal rail 5 which is drivable in vertical reciprocating movement along an axis Z, lengthwise of the legs 4, by means of a drive motor (not shown). The rail 5 supports, for movement lengthwise thereof, along a first horizontal axis X, a drive unit 8 having therein a motor (not shown) for driving the unit 8 along the rail 5. A wiring head 10 is connected to the unit 8 by means of a shaft 12, passing therethrough, for movement at right angles to the rail 5 along a second horizontal axis X, by means of a further drive motor (not shown) in the unit 8. The drive motors which are conveniently stepping motors, are controlled according to a predetermined wiring program, by means of a first electronic control system !4. Beneath the head 10, is a work table 16 on which are supported, in a frame 17, electrical connector housings CH and $CH_1$ of an electronic switch panel assembly which is to be wired by means of the apparatus. There are supported on the head 10 for free rotation in a bracket 18 a wire spool 20 and an electrical terminal strip spool 22.

Figure 3:
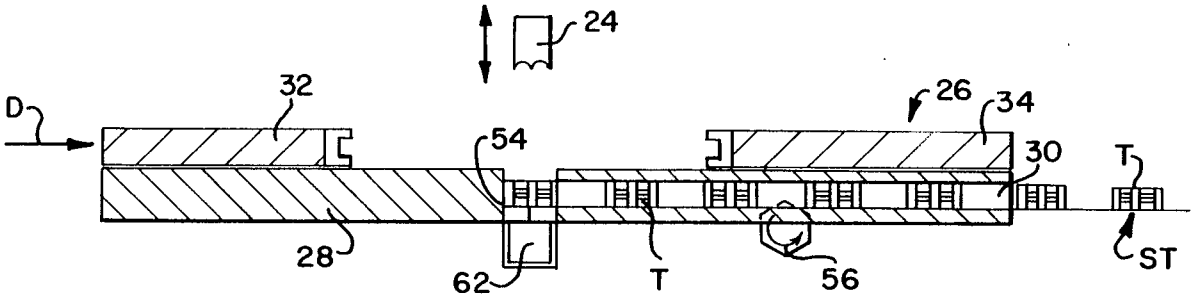
FIG. 3 is a view taken on the lines 3—3 of FIG. 2.
Figure 2:
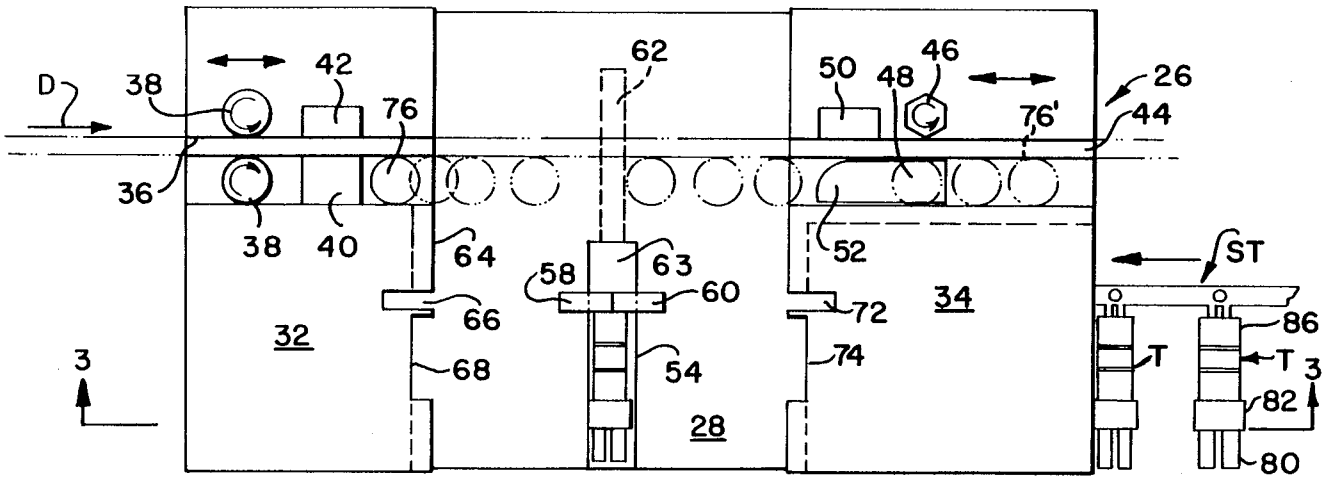
FIG. 2 is a diagrammatic side view illustrating the working parts of a wiring head of the apparatus.

A wire inserter 24 (FIG. 3) in the form of a punch is mounted to the head 10 for horizontal reciprocating movement, by means of a drive motor (not shown), through a downward (as seen in FIG. 3), wire insertion stroke and an upward, as seen in FIG. 3, return stroke. On one side of the inserter 24 is a harness wiring assembly, generally referenced 26 (FIGS. 2 and 3), comprising a support plate 28 formed with a terminal strip channel 30 (FIG. 2) for receiving a strip ST of spaced, juxtaposed, electrical terminals T from the reel 22. Mounted for horizontal reciprocating movement towards and away from one another on the plate 28 are wire looping slides 32 and 34, respectively, arranged to be driven in such movement by stepping motors (not shown) in the head 10. The slide 32 defines a horizontal wire channel 36 for receiving wire W from the reel 20. Mounted on the slide 32, on either side of the channel 36 is a wire feed roll 38 driven by a stepping motor (not shown) on the slide 32, to drive the wire W in a wire feed direction D. Also on the slide 32, down stream of the rolls 38, in the wire feed direction D, are wire clamps 40 and 42, which are moveable between a wire clamping position and a wire release position by means of a solenoid (not shown) on the slide 32.

The slide 34, the downstream slide, defines a horizontal wire channel 44 which is in alignment with the wire channel 36 of the slide 32. On one side of the channel 44 is a wire eject wheel 46 upstream of which, in the wire feed direction D, are wire clamps 48 and 50 which are moveable between a wire clamping position and a wire release position by means of a solenoid (not shown) on the slide 34. The clamp 48 has thereon a wire guiding nose 52, which projects in the direction of the slide 32, that is to say the upstream slide.

The terminal strip receiving channel 30 terminates centrally of the plate 28 and between the slides 32 and 34, in a forwardly and laterally, open, wire terminating station 54, in alignment with the wire inserter 24.

The strip of terminals ST is arranged to be driven stepwise along the channel 30 towards the terminating station 54, by means of a terminal strip feed wheel 56, which protrudes into the channel 30 and which is driven in intermittent rotation by means of a stepping motor (not shown) on the plate 28. Immediately above the station 54 are upstream and downstream wire severing blades 58 and 60, respectively, which are actuable, each be means of an individual solenoid (not shown) on the plate 28. A terminal inserter 62 in the form of a ram mounted on the rear side of the plate 28 (FIG. 3) is slidable, by means of a stepping motor (not shown) on the plate 28, through a downward terminal insertion stroke and an upward return stroke. The inserter 62 has a terminal engaging head 63 which is moveable with the inserter 62 along the opposite side of the plate 28. The downstream edge 64 of the slide 32 is formed with a first recess 66 for receiving the blade 58 and below the recess 66, with a terminal receiving recess 68. The upstream edge 70 of the slide 34 is formed with a recess 72 for receiving the blade 60, and below that, with a terminal receiving recess 74. A wire pulling roll 76 is mounted for movement between an upstream end position on the slide 32 (shown in full lines in FIG. 2), and a downstream end position on the slide 34 in which position the roll 76 is shown in broken lines referenced 76' in FIG. 2, downstream of the ejector wheel 46. The path of movement of the roll 76 is also indicated in broken lines in FIG. 2. The roll 76 is driven between its end positions by means of a stepping motor thereon (not shown).

The stepping motors and solenoids of the head 10 are operated according to the wiring program, by means of a second electronic control system 78 (FIG. 1).

Figure 4:
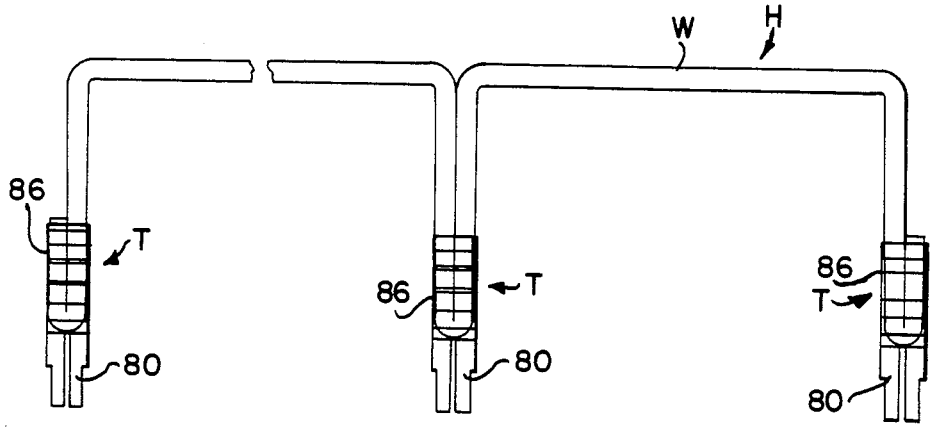
FIG. 4 is a diagrammatic view of an electrical harness produced by means of the apparatus.
Figure 6:
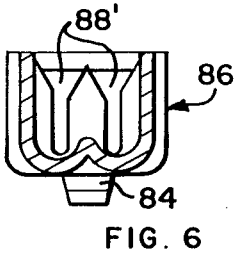
FIG. 6 is a view taken on the lines 6—6 of FIG. 5.
Figure 7:
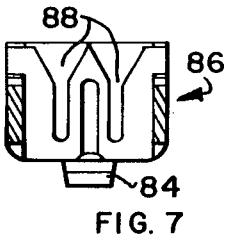
FIG. 7 is a view taken on the lines 7—7 of FIG. 5.
Figure 5:
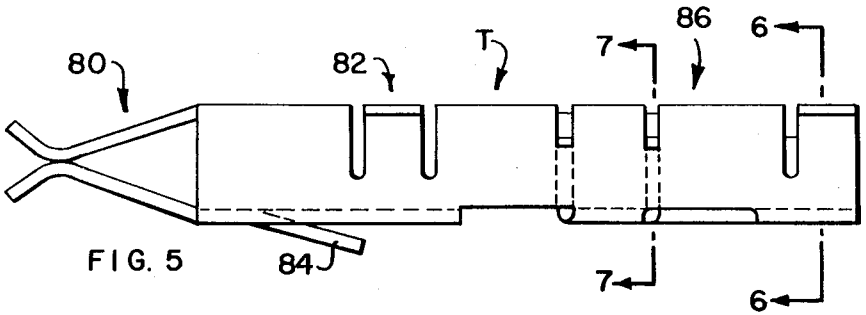
FIG. 5 is a side view of an electrical terminal of the harness.

As shown in FIGS. 5 to 7, each terminal T comprises a mating portion 80 in the form of a tab receptacle, an intermediate portion 82 having a locking tongue 84 and an open, U-section, wire connecting portion 86 comprising two spaced pairs of juxtaposed wire slots 88 and 88' each for receiving a portion of the wire W so that the edges of the slot pierce the insulation of the wire W to make firm electrical contact with the electrically conductive core thereof. As will be apparent from FIG. 4, the wire W needs to be doubled over upon insertion into the wire connecting portion 86 so that a portion of the wire W is received in each of the wire slots 88 and 88' of each pair.

Figure 6A:
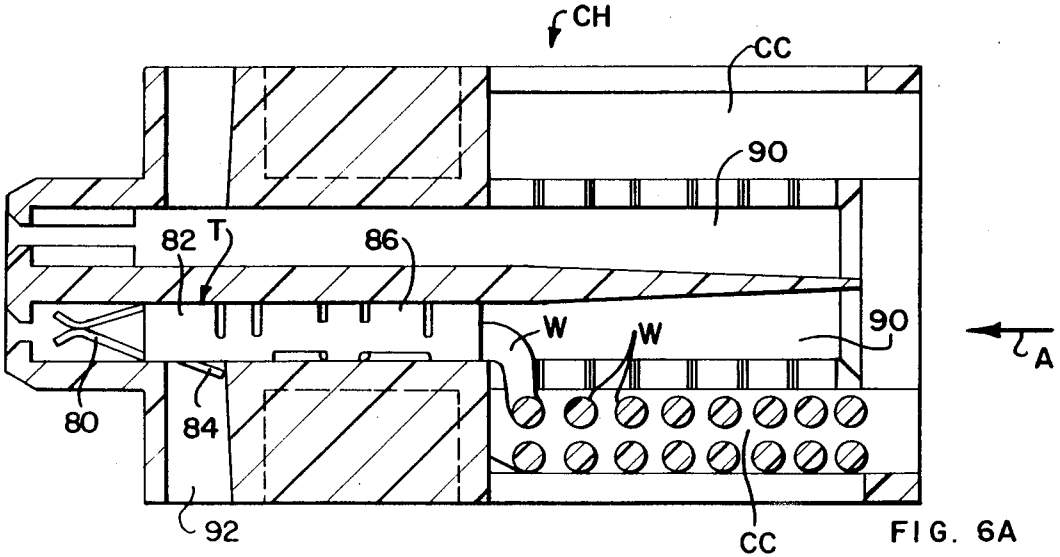
FIG. 6A is a sectional view of an electrical connector.

The apparatus described above is intended to produce harnesses H which, as shown in FIG. 4, each comprise a terminal T at each end of the harness and intermediate its ends, an indefinite number of terminals T. The apparatus is arranged to insert each terminal T, when the wire W has been terminated thereto, into a predetermined cavity 90 of a housing CH, in the direction of the arrow A in FIG. 6A, with the portion 80 of the terminal T leading, so that its locking tongue 84 latches into a recess 92 in the housing CH, with the wire W extending into a cabling channel CC of the housing CH which is open at its left hand (as seen in FIG. 1) side to allow the wires to be laid in cable gutters CG of the frame 17. The wire W will extend between different cavities of the housing according to the wiring program. Some of the terminals are inserted into cavities (not shown) of the housings $CH_1$, according to the program.

Figure 11:
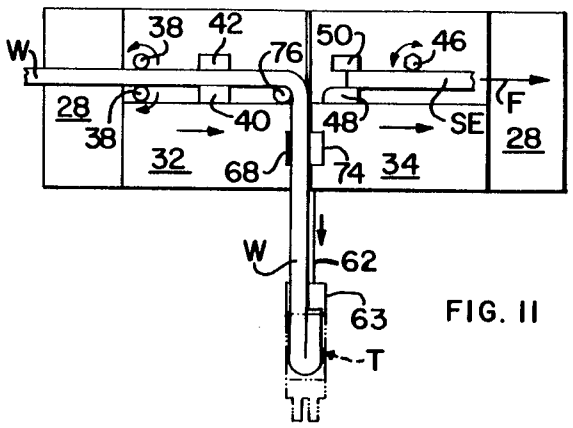
FIGS. 8 to 12 are schematic side views, illustrating successive stages in an operating cycle of the wiring head.
Figure 12:
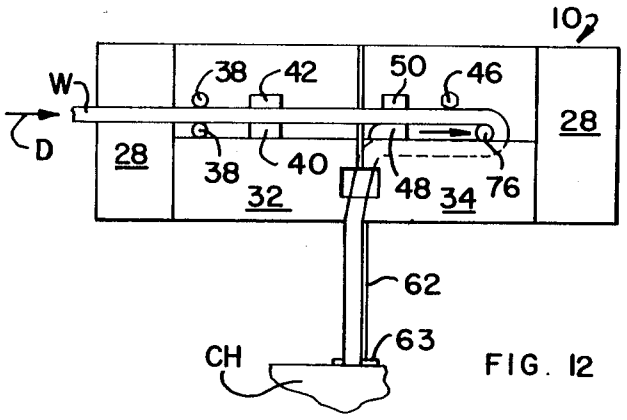
Figure 8:
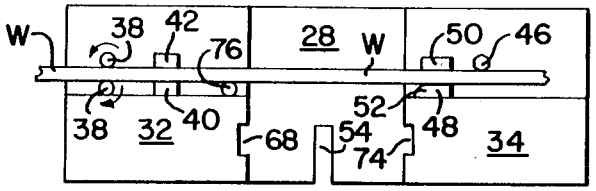
Figure 9:
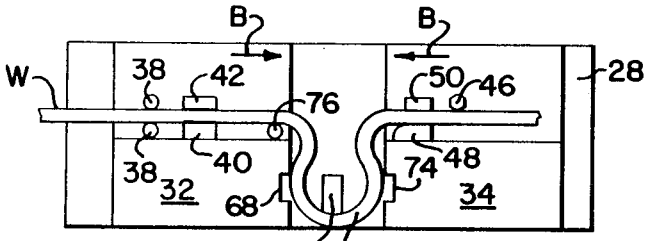
Figure 10:
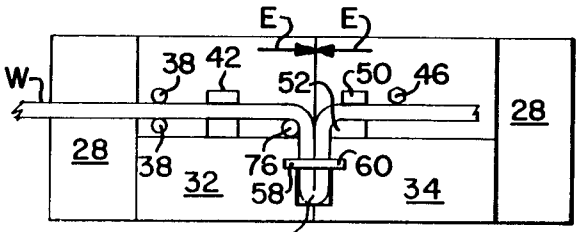

The operation of the wiring apparatus will now be described with reference to FIGS. 8 to 12. Prior to the start of a wiring program, the head 10 is moved along the axes X, Y and Z to bring the terminating station 54 of the head 10 into alignment with a selected cavity of a housing CH or $CH_1$. At the beginning of a cycle of operation of the apparatus (FIG. 8), the wire W has been fed so that it extends through the wire channel 36 of the slide 32 and the wire channel 44 with the clamps 40 and 42, and 48 and 50 in their open position. The roll 76 is in its upstream end position. The clamps 42 and 50 are now closed as indicated by the hatching thereon in FIG. 9 and the slides 32 and 34 are moved towards one another as indicated by the arrows B, so that the wire W forms a wide loop L between the slides 32 and 34, and extending across the terminating station 54. As the slides are further advanced towards one another, as indicated by the arrows E in FIG. 10, the loop L is compressed, guided by the roll 76 and the nose 52, so that the two sides of the loop L are contiguous and are aligned with the wire receiving portion 86 of a terminal T which has previously been fed by the feed wheel 56 into the terminating station 54. The inserter 24 is now driven through its insertion stroke to force each side of the compressed loop L into a wire slot 88 and a wire slot 88' of the portion 86 of the terminal T. The inserter 24 also acts to sever the terminal T from the strip ST. The downstream wire severing blade 60 is then advanced to sever the right hand (as seen in FIG. 10) side of the loop L at a position just back from the terminal T, to provide the connection shown on the left hand side of FIG. 4, in which only one part of the wire W extends from the terminal T. The wire inserter 24 is now driven through its return stroke and terminal inserter 62 is driven through its insertion stroke as shown in FIG. 11 to eject the terminal T from the station 54, towards the housing CH and the wire ejector wheel 46 is rotated to eject the severed end portion SE of the wire W from the apparatus as indicated by the arrow F in FIG. 11, the clamps 40 and 42, and 48 and 50 having been opened to allow the advance of the unsevered part of the wire W and the ejection of the severed portion SE, respectively. When the terminal T has been inserted by the inserter 62 into said selected cavity in accordance with the wiring program, the wire pulling roll 76 is moved from its upstream end position to its downstream end position (FIG. 12), whereby a further length of the wire W is drawn from the reel 20 to allow of a further cycle of operation of the head 10. At the end of each cycle the slides 32 and 34 are returned to their FIG. 8 positions and the inserter 62 is driven through its return stroke.

If according to the program, the wire W is to extend from both sides of the next terminal T, as indicated in respect of the center terminal T in FIG. 4, neither of the wire severing blades 58 or 60 is operated during that cycle. However, upon the completion of one harness H, the upstream wire severing blade 58 is operated to sever the left hand, as seen in FIG. 10, side of the compressed loop L, to produce the connection shown on the left hand side of FIG. 4.

We claim:

1. In Wiring apparatus having means for operatively aligning a wiring head above predetermined cavities in an electrical connector housing to be wired, a wiring head comprising:

an electrical terminal inserter mounted thereto for reciprocating movement through a downward terminal insertion stroke and an upward return stroke;

means on the head for consecutively feeding electrical terminals each having a wire receiving portion, horizontally, and into alignment with the terminal inserter at the end of each return stroke thereof, for the insertion of the terminal into one of said cavities by the terminal inserter during its insertion stroke;

a wire inserter mounted to said head for horizontal reciprocating movement through a wire insertion stroke and a return stroke;

means on said head for feeding wire from a wire source, in a wire feed horizontal direction towards the wire inserter and into alignment therewith, transversely of the direction of the wire insertion and return strokes thereof and at the end of each return stroke thereof;

means moveable in said head, parallel to said wire feed direction, prior to the working strokes of the terminal inserter and the wire inserter, for forming the wire fed by said wire feed means, into a loop aligned with the wire receiving portion of a terminal fed to the terminal inserters for insertion of the wire into said wire receiving portion by the wire inserter during its wire insertion stroke;

means horizontally moveable in said head for selectively severing either side of the loop at a position back from the terminal, in accordance with a connector housing wiring program; and wire pulling means on the head arranged downstream, in said wire direction, of the terminal inserter, for engaging the wire between the terminal and the wire feeding means, following the working stroke of the terminal inserter, to draw further wire from the wire source.

2. A wiring head according to claim 1, wherein the loop forming means comprises an upstream and a downstream, in the wire feed direction, slide, said slides being mounted to the head for movement towards and away from one another, a terminal insertion station for receiving each terminal fed by said terminal feeding means being located between the slides, each slide being provided with means for clamping the wire to the slide during the movement of the slides towards one another and towards said wire insertion station.

3. A wiring head according to claim 2, wherein the wire pulling means comprises a wire pulling roll which is moveable in the wire feed direction, between a position on the upstream slide to a position on the downstream slide, when the slides are nearest to one another.

4. A wire pulling head according to claim 3, wherein means are provided for guiding the sides of the loop into contiguous relationship as the slides approach one another, the sides of the loop being guided into contiguous relationship, between the wire pulling roll when it is positioned on the upstream slide and a wire guiding nose on the downstream slide.

5. A wiring head according to claim 2, wherein the loop severing means comprises upstream and downstream wire severing blades mounted to the head between the slides, the upstream blade being positioned in the head to sever the upstream side of the loop and the downstream blade being positioned in the head to sever the downstream side of the loop.

6. A wiring head according to claim 5, further comprising a wire end portion ejector mounted to the downstream slide for ejecting from the head, an end portion of the wire, which has been severed from the remainder of the wire by the downstream severing blade.

7. A wiring head according to claim 6, wherein each slide is formed with a recess for receiving a respective one of the wire severing blades as the slides approach one another.

8. A wiring head according to claim 2 wherein the means for feeding wire from the wire source comprises a pair of wire drive rolls on the upstream slide, the wire drive rolls being located upstream of the wire clamping means of the upstream slide.

* * * * *